US010058876B2

(12) United States Patent
Michelsen

(10) Patent No.: US 10,058,876 B2
(45) Date of Patent: Aug. 28, 2018

(54) DECANTER CENTRIFUGE WITH DOUBLE AXIAL SEALING

(71) Applicant: ANDRITZ S.A.S., Velizy-Villacoublay (FR)

(72) Inventor: Jan Michelsen, Chateauroux (FR)

(73) Assignee: ANDRITZ S.A.S., Velizy-Vilacoublay (FR)

( * ) Notice: Subject to any disclaimer, the term of this patent is extended or adjusted under 35 U.S.C. 154(b) by 0 days.

(21) Appl. No.: 15/125,638

(22) PCT Filed: Mar. 5, 2015

(86) PCT No.: PCT/EP2015/054586
§ 371 (c)(1),
(2) Date: Sep. 13, 2016

(87) PCT Pub. No.: WO2015/135823
PCT Pub. Date: Sep. 17, 2015

(65) Prior Publication Data

US 2017/0001202 A1 Jan. 5, 2017

(30) Foreign Application Priority Data

Mar. 14, 2014 (EP) ..... 14000941

(51) Int. Cl.
*B04B 1/20* (2006.01)
*B04B 15/00* (2006.01)
*B04B 7/04* (2006.01)

(52) U.S. Cl.
CPC ..... *B04B 1/20* (2013.01); *B04B 7/04* (2013.01); *B04B 15/00* (2013.01);
(Continued)

(58) Field of Classification Search
CPC ..... B04B 1/20–2001/2091
(Continued)

(56) References Cited

U.S. PATENT DOCUMENTS 3,428,247 A * 2/1969 Andresen ..... B04B 1/20 494/15
4,566,873 A * 1/1986 Toda ..... B04B 1/20 494/53

(Continued)

FOREIGN PATENT DOCUMENTS

DE 4132044 C1 * 11/1992 ..... B04B 1/20
JP 2002336735 A * 11/2002

OTHER PUBLICATIONS

Machine Translation of JP2002-336735 A.*

*Primary Examiner* — Charles Cooley
(74) *Attorney, Agent, or Firm* — Alix, Yale & Ristas, LLP

(57) ABSTRACT

A decanter centrifuge with a rotating bowl is provided with at least one solids discharge port and at least one clarified liquid discharge port and a screw conveyor disposed coaxially within the rotating bowl to be rotated in the same direction with a differential rotational speed. A feed suspension to be separated is introduced into a ring shaped space formed between the rotating bowl and the screw conveyor through a central feed pipe fixed to the end of the screw conveyor and supported in at least one bearing. The feed suspension is separated by centrifugal force into a solid phase and a liquid phase so that the solid phase is discharged from the solid discharge port and the liquid phase is discharged from a clarified liquid discharging apparatus. A sealing of the feed pipe and the bowl shaft at the feed end of the feed pipe is provided as adjacent double axial sealing. A liquid phase conduit is arranged in the bowl shaft for guiding the liquid phase outside of the bearings, and a liquid phase valve is provided outside the bearing on the side facing away from the bowl and screw. In this way the liquid phase discharge valve can be varied during operation of the decanter centrifuge by a hand wheel via a transmission or by a motor.

7 Claims, 3 Drawing Sheets

(52) U.S. Cl.
CPC ..... *B04B 2001/2041* (2013.01); *B04B 2001/2075* (2013.01); *B04B 2001/2083* (2013.01)

(58) Field of Classification Search
USPC ..... 494/53–54, 56–57; 210/380.1, 380.3
See application file for complete search history.

(56) References Cited

U.S. PATENT DOCUMENTS

| | | | | | |
|---|---|---|---|---|---|
| 5,169,377 | A * | 12/1992 | Schlip | B04B 1/20 | 210/781 |
| 5,171,205 | A * | 12/1992 | Monkenbusch | B04B 11/082 | 494/10 |
| 5,217,428 | A * | 6/1993 | Schlip | B04B 1/20 | 494/53 |
| 5,542,903 | A * | 8/1996 | Nishida | B04B 1/20 | 494/53 |
| 5,618,409 | A * | 4/1997 | Kreill | B04B 1/14 | 210/149 |
| 9,931,643 | B2 * | 4/2018 | Huyghe | B04B 1/20 | |
| 2004/0185999 | A1 * | 9/2004 | Beyer | B04B 1/20 | 494/53 |
| 2013/0190160 | A1 * | 7/2013 | Yumoto | B04B 1/20 | 494/15 |
| 2017/0001202 | A1 * | 1/2017 | Michelsen | B04B 1/20 | |

* cited by examiner

DECANTER CENTRIFUGE WITH DOUBLE AXIAL SEALING

BACKGROUND

The invention relates to a decanter centrifuge with a rotating bowl provided with at least one solids discharge port and at least one clarified liquid discharge port and a screw conveyor disposed coaxially within said rotating bowl so as to be included in said rotating bowl rotated in the same direction with a differential rotational speed, where a feed suspension to be separated is introduced into a ring shaped space formed between said rotating bowl and said screw conveyor through a central feed pipe fixed to the end of the screw conveyor and supported in at least one bearing and can be separated by centrifugal force into a solid and a liquid phase so that said solid phase is discharged from said solid discharge port and said liquid phase is discharged from said clarified liquid discharging apparatus, whereby a liquid phase conduit is arranged in the shaft guiding the liquid phase outside of the bearings, a liquid phase valve provided outside the bearing on the side facing away from the bowl and screw.

A decanter centrifuge in the state of the art is shown in EP 0 447 742 A2 where the solid discharge port is arranged at the inside of the feed pipe end bearing. The liquid discharge port for the clarified liquid is on the side of the end plate connected to the drive shaft of the bowl and is equipped with a weir, which can be adjusted in its height by an adjusting weir board.

As the drive shaft has to have a certain diameter, usually in the range of the screw shaft, the liquid outlet can only be a great distance away from the axis. This leads to high energy consumption. Also JP 2002 336735 shows a decanter centrifuge with a rotating bowl and rotating screw with a liquid phase conduit arranged in the shaft with a discharge valve.

SUMMARY

The goal of the invention is thus a reduction of power loss from accelerated liquids and solids by reducing the discharge radius to an absolute minimum.

This is achieved by a sealing at the end of the feed pipe and the liquid phase valve being adjustable during operation of the decanter centrifuge. As the feed pipe has a small diameter with regard to a usual drive shaft and the clarified liquid is discharged via a conduit around the feed pipe, the energy consumption is very low.

A further embodiment of the invention is characterized by the sealing at the end of the feed pipe being provided as a double axial sealing. So it can be managed that one seal seals between the rotary feed pipe and the stationary supply pipe for the feed suspension and another seal seals between the headwall shaft of the rotor and the stationary part of the decanter centrifuge. This means that it will be possible to use the pressure from the feed pump to support the cake transport in the solids transporting part of the bowl, thereby eliminating the need for variable speed conveyor control and equipment.

Another embodiment of the invention is characterized by a liquid phase outlet for the clarified liquid being arranged between the bearing and the sealing.

Yet another favourable arrangement of the invention is characterized by the liquid phase valve being adjustable by a motor. The pressurization is created by this valve to the liquid phase discharge, thereby applying the pump pressure to support the cake transport in the solids part of the rotor in a controlled way.

A further advantageous embodiment of the invention is characterized by a channel for lubrication water being provided between the two seals and a bearing at the end of the rotating screw, which is arranged concentrically between the shaft of the rotating bowl and the shaft of the rotating screw.

Another favourable embodiment of the invention is characterized by the liquid phase conduit being arranged in the shaft of the rotating bowl. So it is incorporated in the main part and no separate part.

BRIEF DESCRIPTION OF THE DRAWING

The invention is now described with reference to the accompanying drawings, wherein preferred embodiments of the invention are clearly shown.

DETAILED DESCRIPTION

Figure 1:
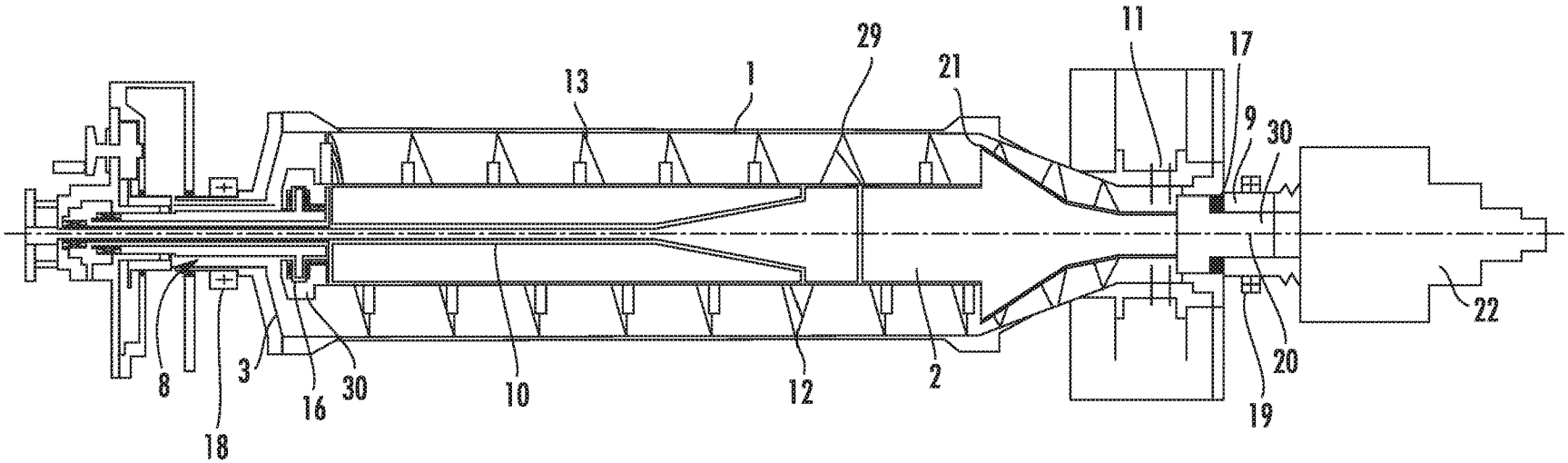
FIG. 1 illustrates a decanter centrifuge according to the present invention.

In FIG. 1 is shown a decanter centrifuge according to the invention, which has the following structure. A rotating bowl 1 is a combination of a conical section and a cylindrical section. A bowl-head 3 is fixed at the larger radius side of the rotating bowl 1 so as to close the rotating bowl 1. The hollow shaft 8 of the bowl-head 3 is extended from the bowl-head 3 so as to communicate with the hollow of the rotating bowl 1. On the other side, at the smaller radius of the rotating bowl 1, the hollow shaft 9 is extended from the back end of the bowl 1, so as to communicating with the hollow of the rotating bowl 1. The hollow shaft 8 of the bowl-head 3 and the hollow shaft 9 of the bowl 1 are pivoted in bearings 18 and 19 respectively. Accordingly, the rotating bowl 1 can be supported horizontally and rotated with a high speed by a rotational force, which is transmitted by rotating driving means (not shown).

In the hollow portion of the rotating bowl 1, a screw conveyor 2 is provided. The screw conveyor 2 is pivoted coaxially with the rotating horizontal axis of the bowl 1 with its shaft 30 supported by means of bearings 16 and 17. Bearing 16 is situated between the radially extending slotted portion of the conveyor shaft 30 that projects axially from the tube 12 at the feed end of the conveyor 2, and a radial projection from bowl shaft 8, into the slot. A hollow tube 12 of the screw conveyor 2 is provided coaxially at the centre of the rotating bowl 1. A screw blade 13 extends helically the full length of the hollow tube 12 so as to almost reach the inner surface of the bowl 1. In the hollow shaft 9 of the back end a transforming shaft 20 is provided. Its one end is connected to the end part of the hollow tube 12 of the screw conveyor 2 and its other end is connected to conveyor drive 22. Thus the bowl 1 with the screw conveyor 2 can be rotated with the high rotational speed. The rotating bowl 1 and the screw conveyor 2 are rotated in the same direction, while there is a slightly differential speed between them. This may be either accomplished by a gear unit or by different types of conveyor drives.

A solid discharge port 11 is formed at the smaller radius side of the rotating bowl 1 so that solidified particles scraped together can be discharged from the solids discharge port 11.

The portion, where the clarified liquid is discharged will be explained closely referring to FIG. 2, as the present invention is characterized by this portion.

Figure 2:
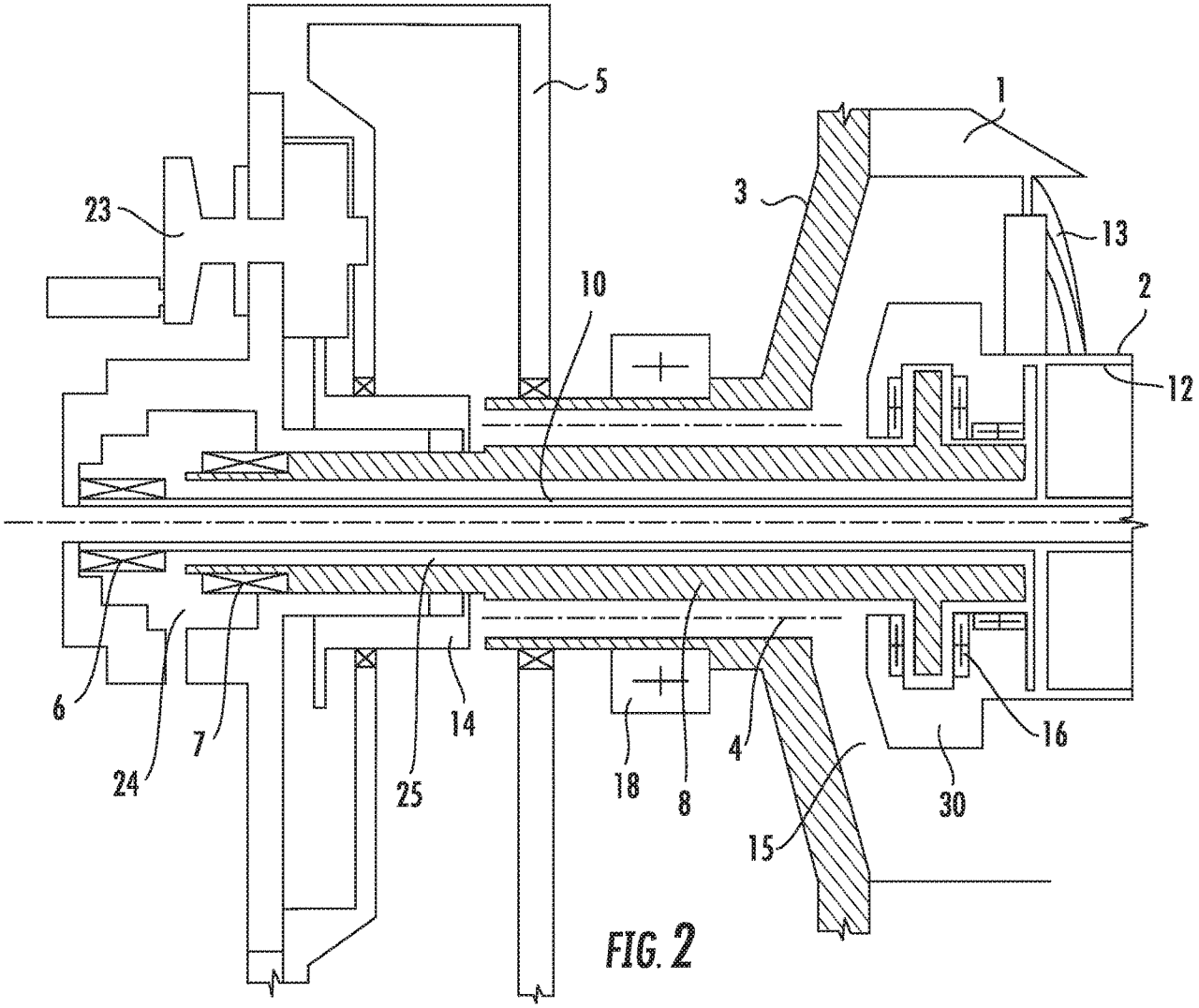
FIG. 2 shows the feed end of the decanter centrifuge with the liquid phase valve.

FIG. 2 shows the end part of the decanter centrifuge at the side of the bowl-head 3. The bowl-head 3 is fixed to the rotating bowl 1. The rotating speed may be approximately 4000 rpm as an example. Inside is the rotating screw conveyor 2 with the hollow tube 12 and the thereon fixed blades 13. The screw conveyor 2 rotates in the same direction as the bowl 1. In case it is faster it may run at a speed of approximately 4012 rpm, which is slightly different to the rotational speed of the rotating bowl 1. The screw conveyor 2 is pivoted coaxially with the rotating horizontal axis of the bowl 1 by means of bearing 16. Bowl-head 3 is extended by a hollow shaft 8 which is supported by a bearing stand 18. Feed pipe 10 is protruding inside the hollow shaft 8 of the rotating bowl 1 from the hollow tube 12 of screw conveyor 2 and is rotating with the screw conveyor. When the feed suspension to be separated is supplied from feed pipe 10, while the rotating bowl 1 and the screw conveyor 2 are rotating with each high rotational speed, the feed suspension is introduced to the external side of the hollow tube 12 through feed ports 29 as known in the state of the art. So the introduced feed suspension is continuously splashed towards the peripheral inner surface of the rotating bowl 1 by a centrifugal force caused by the rotation of the rotating bowl 1. Therefore a ring shaped pool is formed along the peripheral internal face of the rotating bowl 1. The solid particles of higher density than the liquid of the feed suspension are separated from the clarified liquid to be precipitated by the high g-force created by the rotational speed on the bottom of the pool. These particles are scraped towards the conical end of the bowl 1 of FIG. 1 by means of the screw blades 13 and discharged from the solids discharge port 11.

On the other side the clarified liquid, which collects on the outer surface of the hollow tube 12, flows to a channel 15 and enters a liquid phase conduit 4, which is formed in the shaft 8. This liquid phase conduit 4 extends trough the bowl-head 3 and the bearing stand 18 and opens into liquid phase outlet 5. While the liquid phase conduit 4 is rotating with the bowl 1, the liquid phase outlet 5 is stationary. The amount of liquid phase (clarified liquid) can be controlled with a liquid phase discharge valve 14. This liquid phase discharge valve 14 may be varied by a hand wheel 23 via a transmission or alternatively by a motor. By varying the liquid phase discharge valve 14 it will be possible to use the pressure from the feed pump (not shown) to support the cake transport in the solids transporting part of the bowl 1, thereby eliminating the need for variable speed conveyor control and equipment.

When the bowl 1 is rotating, liquid and solids fed into the bowl cavity will form a ring shaped volume, and solids having a higher density than the liquid will separate and accumulate on the inside of the bowl 1 forming a pool. If only liquid is supplied, the level of liquid inside the bowl will be constant and defined by the discharge port 11 having the largest radius from the rotational centre. A baffle disc 21 arranged on the conveyor will form a barrier between a separation part and a solids transport part of the bowl cavity, only leaving a small gap between the bowl wall and the baffle periphery. As the conveyor starts to transport separated solids towards the solids discharge port, this gap becomes filled with solids of a high viscosity, thereby forming a plug that causes the liquid level in the separation part of the bowl to become closer to the rotational centre, until it reaches the liquid discharge radius (which is smaller than the solids discharge radius). As the pressure at the gap is grossly proportional to the liquid level height, the pressure on the separation side of the baffle will become larger than the pressure on the transport side of the baffle and this pressure difference thereby aid the transport of solids through the gap and "up" to the solids discharge level. As the conduit between the feed pump and the bowl cavity is sealed, the pressure from the feed pump will add to the pressure in the cavity if the level inside the cavity comes closer to the rotational axis than the liquid discharge radius. The liquid phase discharge valve 14 will, when becoming partly closed, increase the pressure loss across the liquid discharge port and thereby increase the liquid discharge level, until it becomes coincident with the axis, and the bowl cavity is filled. When the cavity is filled, the pressure from the feed pump directly adds to the pressure at the baffle gap created by the centrifugal force, and the solids flow through the gap can therefore be controlled by regulation of the liquid phase valve gap.

As the solids transport can be controlled by the liquid phase discharge valve 14 as explained above, the dependency of the solids dryness of the conveyor speed is becoming less, and it will be possible to remove the control system for the conveyor speed and only have a fixed speed defined by the conveyor transmission ratio.

At the feed end, rotating feed pipe 10 is sealed by axial seal 6, while rotating bowl 1 is sealed by axial seal 7. Between axial seal 6 and axial seal 7 there is a space 24 into which cooling or lubrication water is introduced under pressure. This water flows through lubrication water channel 25 to the bearing 16 around screw shaft portion 30. Here also a portion of the clarified liquid may be used as lubrication water, so no fresh water is needed.

Figure 3:
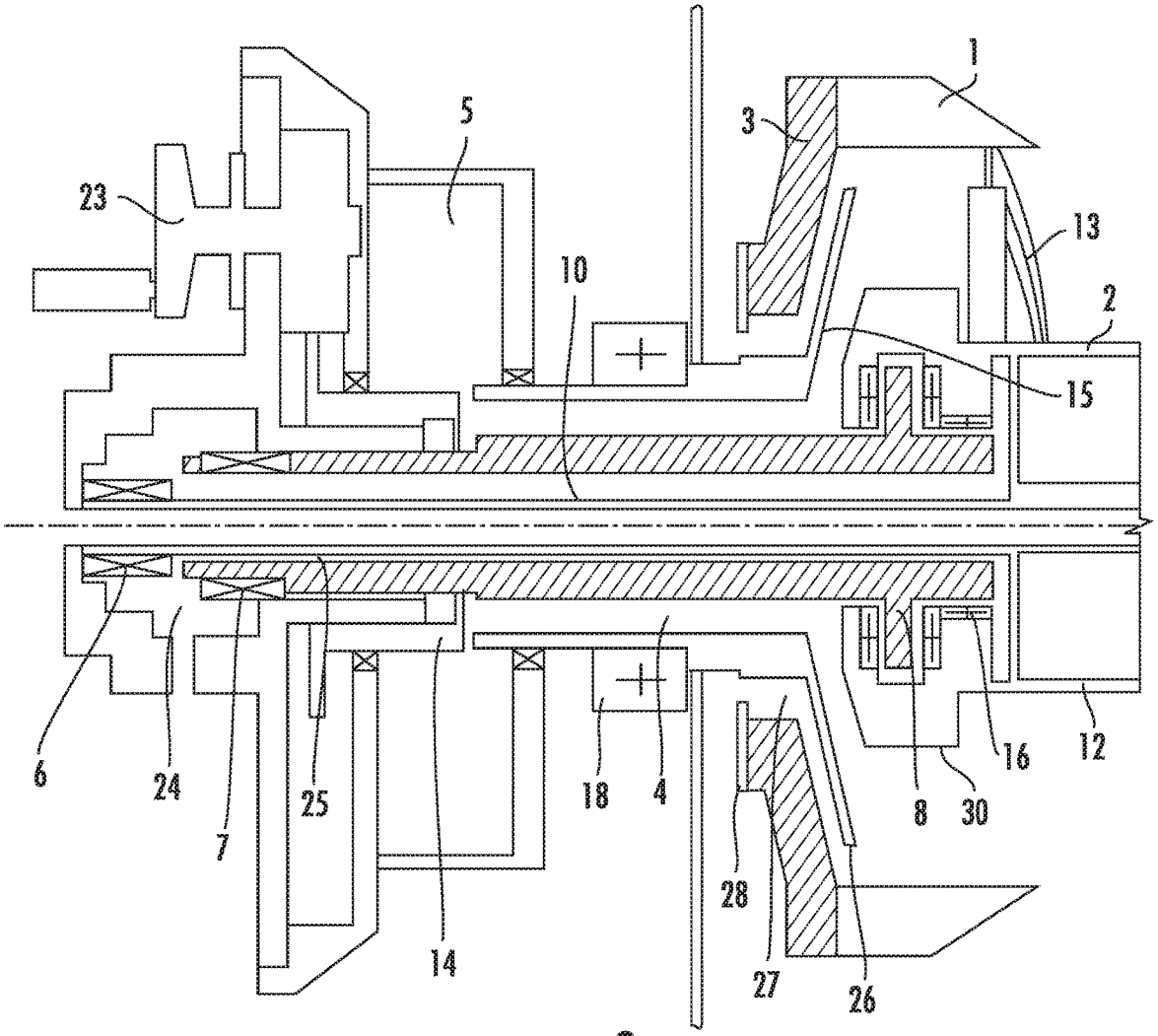
FIG. 3 shows an alternative arrangement for a three-phase application.

In FIG. 3 an embodiment of the invention is shown which is useful when three phases exist. It operates similar to the embodiment of FIGS. 1 and 2, so that the solids are discharged on the end of the small radius of the rotating bowl 1 (not shown here) and the liquid phase may be separated into a light phase and a heavy phase. While the light phase follows the way already described earlier through liquid phase conduit 4 into liquid phase outlet 5, an additional conical ring weir 26 is provided, which separates the light phase and the heavy phase. The heavy phase then passes through an opening 27 which is covered by a ring shaped weir 28, to adjust the height of the opening and thus gives a possibility of adjusting the properties of the phases. Further parts have the same reference numerals as corresponding parts in the other figures.

While preferred embodiments have been shown in the figures and described, it is apparent that the present invention is not limited to the specific embodiments thereof.

The invention claimed is:

1. A decanter centrifuge comprising:

a rotating bowl (1) with a bowl shaft (8, 9) supported in axially spaced apart bowl shaft bearings (18, 19) at a feed end and an opposite end of the bowl, and provided with at least one solids discharge path (11) and at least one clarified liquid discharge path (4, 5);

a rotating screw conveyor (2) disposed coaxially within said rotating bowl (1) and having a screw shaft supported in axially spaced apart conveyor shaft bearings (16, 17) at a feed end and an opposite end, rotated in the same direction with a differential rotational speed as the bowl;

a central feed pipe (10) fixed to the screw conveyor (2), for receiving a feed suspension at a feed end and introducing a feed suspension to be separated into a ring shaped space formed between said rotating bowl (1) and said screw conveyor (2);

wherein said feed suspension is separated by centrifugal force into a solid and a liquid phase so that said solid phase is discharged through said at least one solid discharge path (11) and said liquid phase is discharged from said at least one clarified liquid discharging path (4, 5);

a liquid phase conduit (4) arranged in the bowl shaft (8) for guiding the liquid phase axially outside of the bowl shaft bearing (18) at the feed end;

a liquid phase discharge valve (14) fluidly connected to the liquid phase conduit (4) axially outside the bowl shaft bearing (18) at the feed end;

a control device for varying the discharge valve (14) during operation of the decanter centrifuge;

a sealing of the feed pipe (10) and the bowl shaft (8) at the feed end of the feed pipe (10), provided as double axial sealing (6, 7) by the feed pipe (10) sealed by a first seal (6), and the bowl shaft (8) sealed by an axially spaced second seal (7);

wherein a channel (25) for lubrication water is provided between said double axial sealing (6) and the conveyor shaft bearing (16) at the feed end of the rotating screw conveyor (2), which channel is arranged concentrically between the shaft (8) of the rotating bowl (1) and the screw shaft of the rotating screw conveyor (2).

2. The decanter centrifuge according to claim 1, wherein a liquid phase outlet (5) for the clarified liquid is arranged between the bowl shaft bearing (18) at the feed end and the sealing (6).

3. A decanter centrifuge comprising:

a rotating bowl (1) with a bowl shaft (8, 9) supported in axially spaced apart bowl shaft bearings (18, 19) at a feed end and an opposite end of the bowl, and provided with at least one solids discharge path (11) and at least one clarified liquid discharge path (4, 5);

a rotating screw conveyor (2) disposed coaxially within said rotating bowl (1) and having a screw shaft supported in axially spaced apart conveyor shaft bearings (16, 17) at a feed end and an opposite end, rotated in the same direction with a differential rotational speed as the bowl;

a central feed pipe (10) fixed to the screw conveyor (2), for receiving a feed suspension at a feed end and introducing a feed suspension to be separated into a ring shaped space formed between said rotating bowl (1) and said screw conveyor (2);

wherein said feed suspension is separated by centrifugal force into a solid and a liquid phase so that said solid phase is discharged through said at least one solid discharge path (11) and said liquid phase is discharged from said at least one clarified liquid discharging path (4, 5);

a liquid phase conduit (4) arranged in the bowl shaft (8) for guiding the liquid phase axially outside of the bowl shaft bearing (18) at the feed end;

a liquid phase discharge valve (14) fluidly connected to the liquid phase conduit (4) axially outside the bowl shaft bearing (18) at the feed end;

a control device for varying the discharge valve (14) during operation of the decanter centrifuge; and a sealing of the feed pipe (10) and the bowl shaft (8) at the feed end of the feed pipe (10), provided by a double axial sealing including a first seal (6) for the feed pipe and an axially spaced second seal (7) for the bowl shaft (8);

a liquid phase outlet (5) for the clarified liquid is arranged between the bowl shaft bearing (18) at the feed end and the double axial seals (6,7); and a channel (25) for providing lubrication water to the conveyor shaft bearing (16) at the feed end of the screw shaft has an entry in the space between said double axial seals and extends concentrically toward said conveyor shaft bearing (16), between the bowl shaft (8) and the feed pipe (10).

4. The decanter centrifuge according to claim 3, wherein a liquid phase outlet (5) for the clarified liquid is arranged between the bowl shaft bearing (18) at the feed end and the sealing (6).

5. A decanter centrifuge comprising:

a bowl (1) having a feed end and an opposite, solids discharge end;

a bowl shaft (8, 9) at each end of the bowl, for rotating the bowl about a longitudinal axis;

a bowl shaft bearing (18, 19) at a respective end of the bowl shaft;

a hollow-tube screw conveyor (2) disposed coaxially within said rotating bowl (1), with screw shafts supported in, two axially spaced apart screw shaft bearings (16,17) respectively at the feed and discharge ends of the bowl, for rotation in the same direction as the bowl with a differential rotational speed;

a central feed pipe (10) fixed to the screw conveyor (2) for corotation with the screw conveyor, extending coaxially through the screw conveyor to a feed port (29) where feed material passes radially out of the feed pipe and enters a ring shaped space formed between the rotating bowl (1) and said screw conveyor (2), whereupon the feed material is separated by centrifugal force into a solid phase and a liquid phase;

at least one solids discharge port (11) at the discharge end of the bowl;

at least one clarified liquid discharge port (5) at the feed end of the bowl;

a liquid phase conduit (4) in the bowl shaft (8), for guiding the clarified liquid phase axially outside of the bowl shaft bearing (18) at the feed end;

an adjustable liquid phase discharge valve (14) axially outside the bowl shaft bearing (18) at the feed end of the bowl; and wherein axially outside the bowl shaft bearing (18) at the feed end of the bowl, the feed pipe (10) is sealed by a first seal (6), and the bowl shaft (8) is sealed by second seal (7).

6. The decanter centrifuge according to claim 5, wherein the clarified liquid discharge port (5) is arranged between the bowl shaft bearing (18) at the feed end, and said first and second seals (6,7).

7. The decanter centrifuge according to claim 5, wherein a channel (25) for lubrication water is provided between said seals (6, 7) and the screw shaft bearing (16) at the feed end of the screw conveyor (2), which channel is arranged concentrically between the bowl shaft (8) and the feed pipe (10).

* * * * *